US006623242B2

(12) United States Patent
Vranjes et al.

(10) Patent No.: US 6,623,242 B2
(45) Date of Patent: Sep. 23, 2003

(54) TORQUE PIN

(76) Inventors: Petar Vranjes, 147 Homeside Avenue, Stoney Creek, Ontario (CA), L8G 3G9; Mico Segrt, 284 Green Road, Stoney Creek, Ontario (CA), L8E 2A7

( * ) Notice: Subject to any disclaimer, the term of this patent is extended or adjusted under 35 U.S.C. 154(b) by 0 days.

(21) Appl. No.: 10/080,267

(22) Filed: Feb. 21, 2002

(65) Prior Publication Data

US 2002/0136640 A1 Sep. 26, 2002

Related U.S. Application Data

(60) Provisional application No. 60/271,700, filed on Feb. 28, 2001.

(51) Int. Cl.[7] ..... F01D 5/06

(52) U.S. Cl. ..... 415/216.1; 416/198 A; 416/244 A

(58) Field of Search ..... 415/216.1; 416/198 A, 416/244 A

(56) References Cited

U.S. PATENT DOCUMENTS 3,631,688 A * 1/1972 Quick ..... 464/182
6,287,079 B1 * 9/2001 Gosling et al. ..... 416/220 R
6,435,831 B1 * 8/2002 Ichiryu ..... 416/198 A

* cited by examiner

*Primary Examiner*—Ninh H Nguyen
(74) *Attorney, Agent, or Firm*—Baker & Daniels

(57) ABSTRACT

A torque pin includes a generally cylindrical body defining an external sidewall and having a longitudinal extending bore formed therein. The body also has a radially extending slot provided in the sidewall that intersects the bore. A cam is pivotally coupled to the body and is accommodated by the slot. The cam is moveable between an unlocking condition where the cam is fully accommodated by the slot and a locking condition where the cam is partially accommodated by the slot and extends outwardly beyond the sidewall. A retaining mechanism is disposed in the bore. The retaining mechanism acts on the cam when the cam is in the unlocking condition and moves into the slot when the cam is in the locking condition thereby to inhibit the cam from returning to the unlocking condition.

20 Claims, 6 Drawing Sheets

TORQUE PIN

CROSS-REFERENCE TO RELATED APPLICATION

This application is related to and claims the benefit under 35 U.S.C. §119(e) of U.S. Provisional Patent Application Serial No. 60/271,700, filed Feb. 28, 2001.

FIELD OF INVENTION

The present invention relates generally to rotating machinery and more particularly to a torque pin to maintain adjacent disks of a turbine in alignment and to a turbine incorporating the same.

BACKGROUND OF THE INVENTION

Conventional turbines and compressors (hereinafter referred to collectively as "turbines") include a rotating shaft supporting a plurality of disks or rings (hereinafter referred to as "disks"). During operation, the shaft and disks are typically rotated at a high speed. To maintain adjacent disks aligned and inhibit relative movement between the disks as the disks are rotated, torque pins are employed to engage each pair of adjacent disks at circumferentially spaced locations. In large turbines, hundreds of torque pins are used. The design of the torque pins therefore, has a significant impact on the manpower required during installation and maintenance of large turbines.

Different types of torque pins to align adjacent disks and inhibit relative movement between adjacent disks have been considered. For example, one common type of torque pin includes an elongate body having flanges at its opposite ends. Each flange is bolted to a respective one of a pair of adjacent disks. Although this type of torque pin works satisfactorily to align adjacent disks, the design suffers a serious drawback. Since this type of torque pin must be bolted to adjacent disks, installation and removal of the torque pin is extremely time consuming.

To facilitate installation, Westinghouse Canada Inc. manufactures an alternative torque pin design. This torque pin includes an elongate cylindrical body having a cam slot formed in the sidewall of the body. A centrally disposed, threaded bore extends from one end of the body to the cam slot. A cam is accommodated in the cam slot and is rotatably coupled to the body. The cam can be moved from a retracted position within the body, to an extended position where the cam extends outwardly of the body. When the cam extends outwardly of the body, the cam engages adjacent disks to maintain them in alignment. During installation, a key is used to hold the torque pin in place between adjacent disks. A threaded fastener is then advanced into the bore until the fastener bears against the cam and forces the cam out of the cam slot to the extended position. The threaded fastener is advanced down the bore to the point where the fastener splits. In this manner, the fastener cannot be unthreaded from the bore. As a result, the cam is unable to move back into the body and therefore, remains in the extended position.

Although this torque pin design requires less time to install than the previously described torque pin, it is still relatively time consuming to install. Also, if the fastener does not split properly, during operation of the turbine, vibrations may cause the fastener to dislodge from the bore, in which case, the cam is then able to rotate back into the body. If this occurs, the torque pin may dislodge from between adjacent disks, which can be catastrophic. In addition, since the fastener splits within the bore when the torque pin is properly installed, the torque pin cannot be re-used once it has been removed during maintenance of the turbine.

As will be appreciated, improvements in the design of torque pins are desired. It is therefore an object of the present invention to provide a novel torque pin and to a turbine incorporating the same.

SUMMARY OF THE INVENTION

According to one aspect of the present invention there is provided a torque pin to maintain rotating disks in alignment comprising:

- an elongate body having a slot provided in a sidewall thereof;
- a locking element coupled to said body and being moveable relative to said body from a retracted condition where said locking element is accommodated in said slot to an extended condition where said locking element extends outwardly beyond said sidewall; and
- a retaining mechanism disposed in said body, said retaining mechanism being biased towards said slot to maintain said locking element in said extended condition.

In a preferred embodiment, the retaining mechanism maintains the locking element in the extended condition and in the retracted condition. In the extended condition, the retaining mechanism extends into the slot to inhibit the locking element from moving to the retracted condition. In the retracted condition, the retaining mechanism abuts the locking element to inhibit the locking element from moving to the extended condition. Preferably, the retaining mechanism includes a spring and a retaining element. The spring urges the retaining element into contact with the locking element when the locking element is in the retracted condition and urges the retaining element into the slot when the locking element is in the extended condition.

In one embodiment, the body has a centrally disposed bore therein with the bore including a larger diameter portion and a smaller diameter portion to define an internal shoulder. The larger diameter portion intersects the slot. The retaining element includes a smaller diameter portion and a larger diameter portion to define an annular abutment surface. The spring is disposed in the larger diameter portion of the bore and bears against the larger diameter portion of the retaining element. The annular abutment surface contacts locking element in the retracted condition and contacts the internal shoulder in the extended condition so as to position the larger diameter portion in the slot. Preferably, the smaller diameter portion of the bore extends to the end of the body with the smaller diameter portion of the bore and the smaller diameter portion of the retaining element being generally the same length.

According to another aspect of the present invention there is provided a torque pin comprising:

- a generally cylindrical body defining an external sidewall and having a longitudinally extending bore formed therein, said body also having a radially extending slot provided in said sidewall that intersects said bore;
- a cam pivotally coupled to said body and being accommodated by said slot, said cam being moveable between an unlocking condition where said cam is fully accommodated by said slot and a locking condition where said cam is partially accommodated by said slot and extends outwardly beyond said sidewall; and
- a retaining mechanism disposed in said bore, said retaining mechanism acting on said cam when said cam is in said unlocking condition and moving into said slot when said cam is in said locking condition thereby to inhibit said cam from returning to said unlocking condition.

According to yet another aspect of the present invention there is provided a turbine comprising:

a rotatable shaft;

a plurality of disks on said shaft, adjacent disks having facing recesses formed therein to define torque pin cavities; and torque pins accommodated in said torque pin cavities, each of said torque pins including:

an elongate body having a slot provided in a sidewall thereof;

a locking element coupled to said body and being moveable relative to said body between a retracted condition where said locking element is accommodated in said slot and an extended condition where said locking element extends outwardly beyond said sidewall; and a retaining mechanism disposed in said body, said retaining mechanism being biased towards said slot to maintain said locking element in said extended condition.

The present invention provides advantages in that the torque pin can be installed and removed easily and quickly by a single technician thereby significantly reducing the manpower required during installation and maintenance of large turbines. Also, since the torque pin body fully captures the retaining element, the torque pin is unlikely to be dislodged during operation of the turbine. Furthermore, the centrifical forces placed on the torque pin due to the high speeds of rotation of the turbine, enhance the performance and security of the torque pin.

BRIEF DESCRIPTION OF THE DRAWINGS

An embodiment of the present invention will now be described more fully with reference to the accompanying drawings in which.

DETAILED DESCRIPTION OF THE PREFERRED EMBODIMENT

Figure 1:
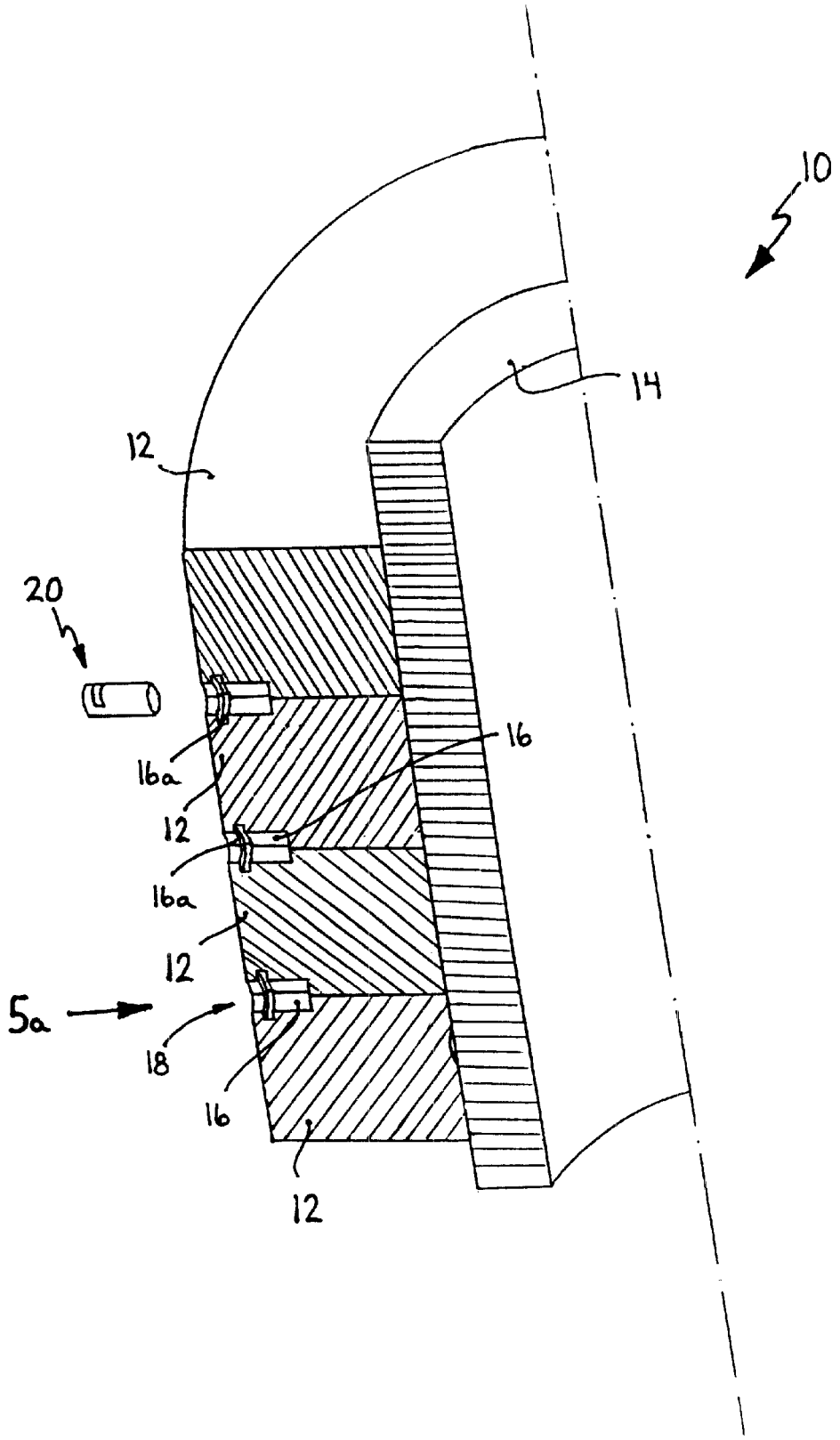
FIG. 1 is a perspective view, partly in section, of a portion of a turbine showing a plurality of disks and a torque pin in accordance with the present invention.

Turning now to FIG. 1, a portion of a turbine is shown and is generally identified by reference numeral 10. As can be seen, turbine 10 includes a plurality of disks 12 secured to a rotating shaft 14. The disks 14 have recesses 16 formed therein at circumferentially spaced locations. Each recess 16 is generally semi-cylindrical but includes a band 16*a* of increased diameter that is spaced slightly inwardly of the peripheral edge of the disk 14. The recesses 16 in adjacent disks 14 face one another to define generally cylindrical torque pin cavities 18. The torque pin cavities 18 receive torque pins 20. The torque pins 20 engage adjacent disks 14 to maintain the disks in alignment and inhibit relative movement between adjacent disks. Although only one torque pin cavity 18 is shown for each adjacent pair of disks 14, those of skill in the art will appreciate that torque pin cavities 18 are located at equally spaced locations about the circumference of each adjacent pair of disks 14.

Figure 2:
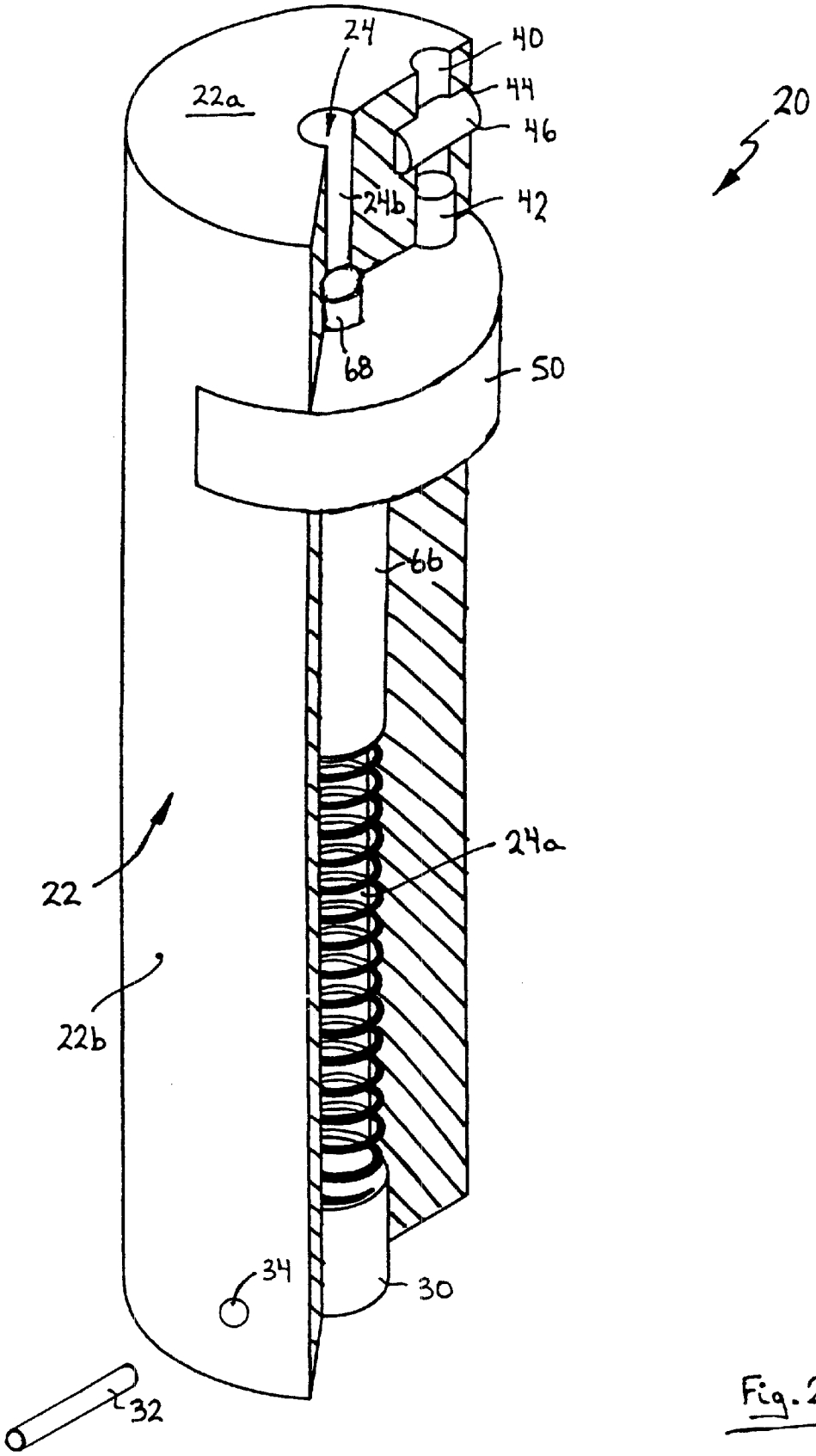
FIG. 2 is a perspective view, partly in section of the torque pin in an unlocking condition.
Figure 3:
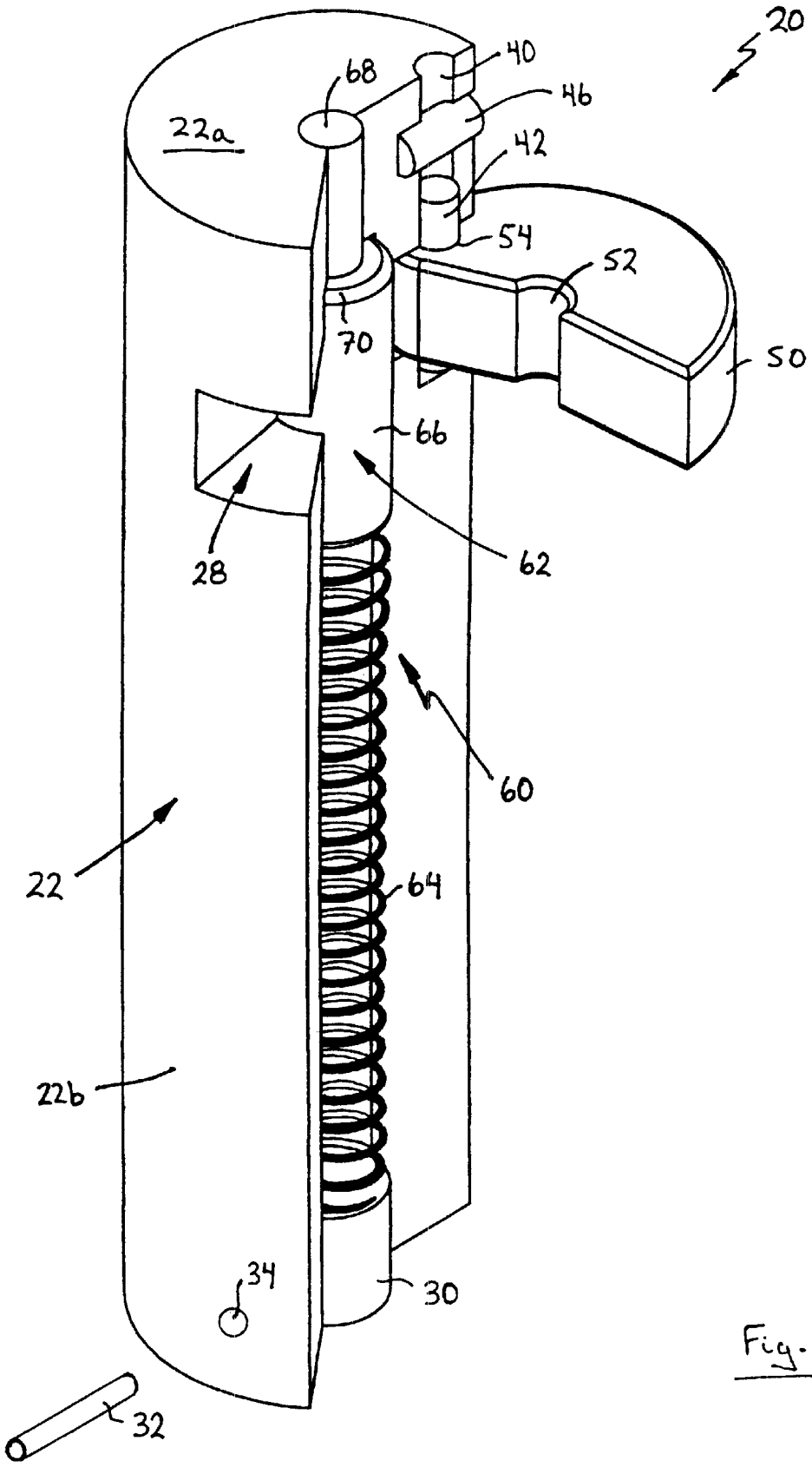
FIG. 3 is a perspective view, partly in section, of the torque pin in a locking condition.
Figure 4:
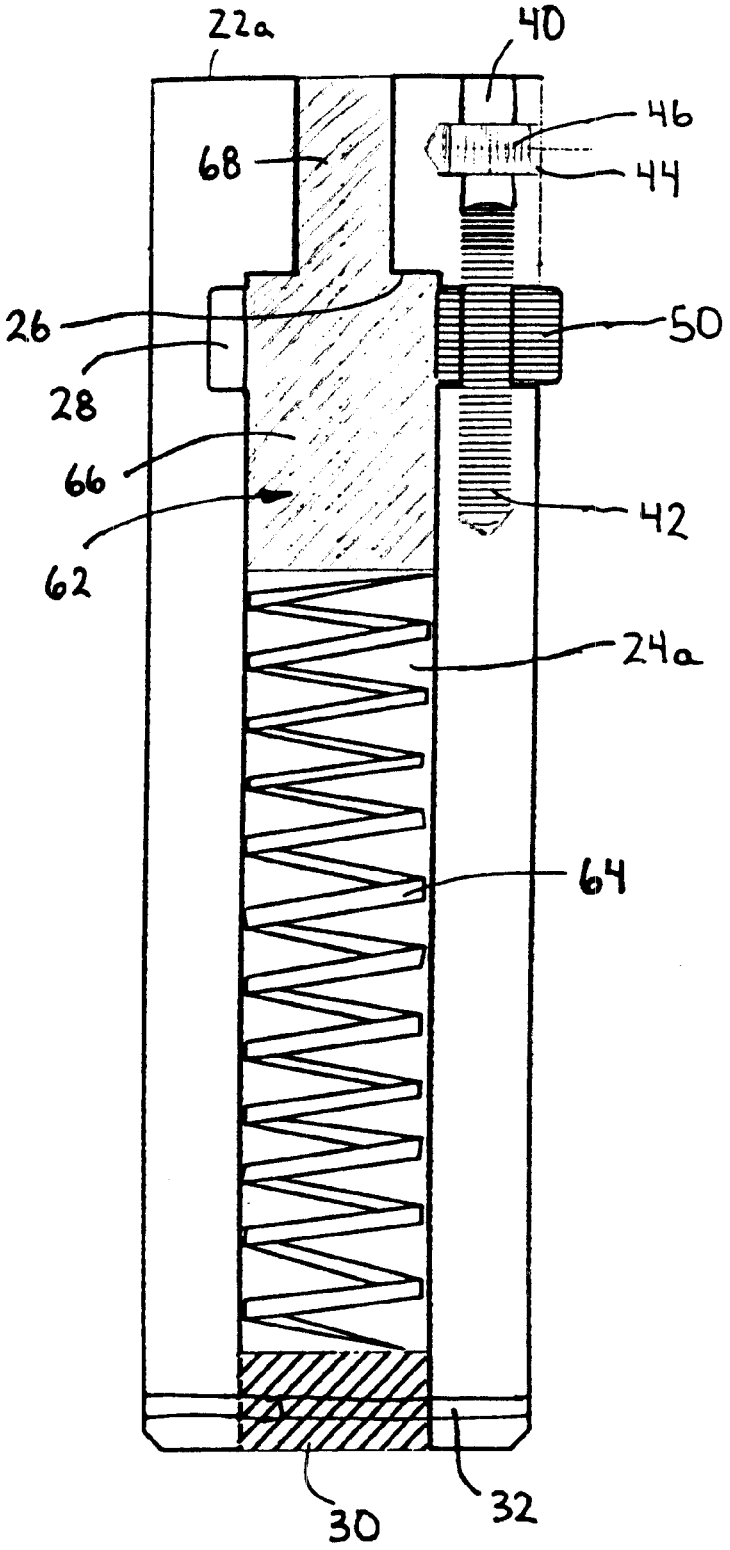
FIG. 4 is an axial sectional view of the torque pin.
Figure 5A:
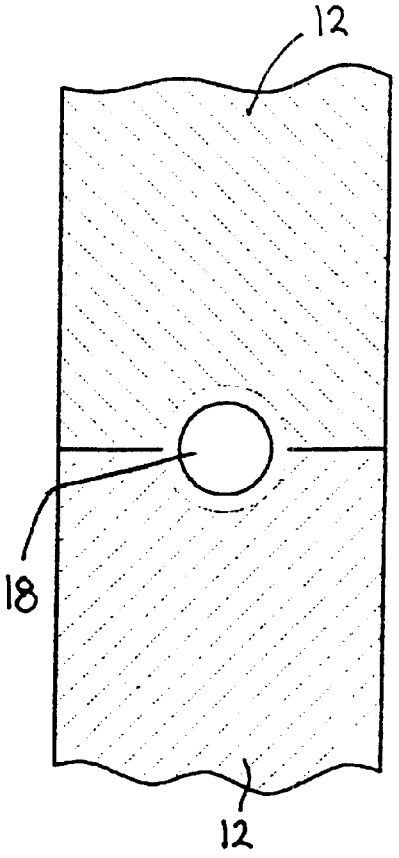
FIG. 5*a* is an elevational view of a portion of the turbine of FIG. 1 taken in the direction of arrow 5*a* showing a pair of adjacent disks and a torque pin cavity.
Figure 5B:
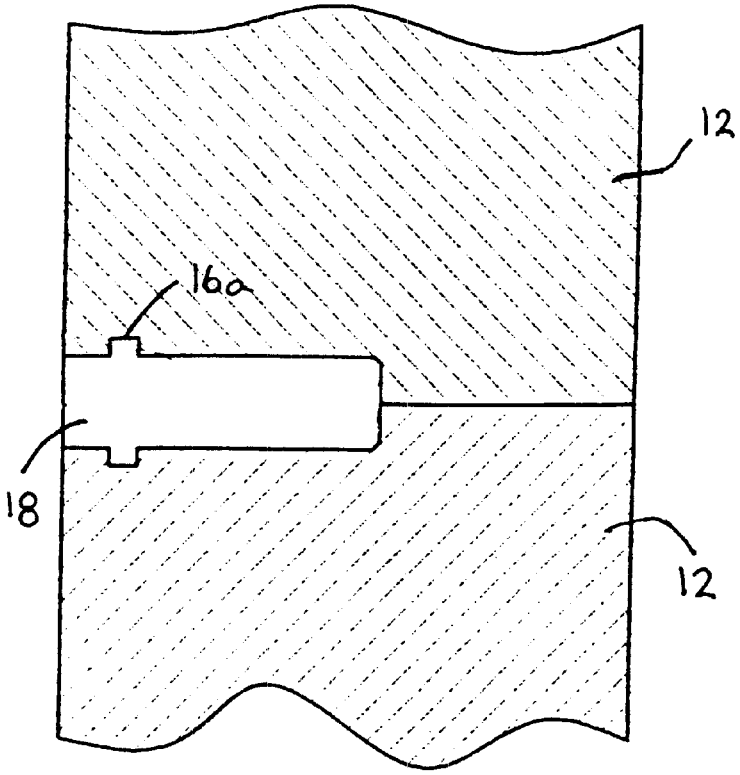
FIG. 5*b* is an enlarged side elevational view of the portion of FIG. 5*a;*
Figures 6A, 6B:
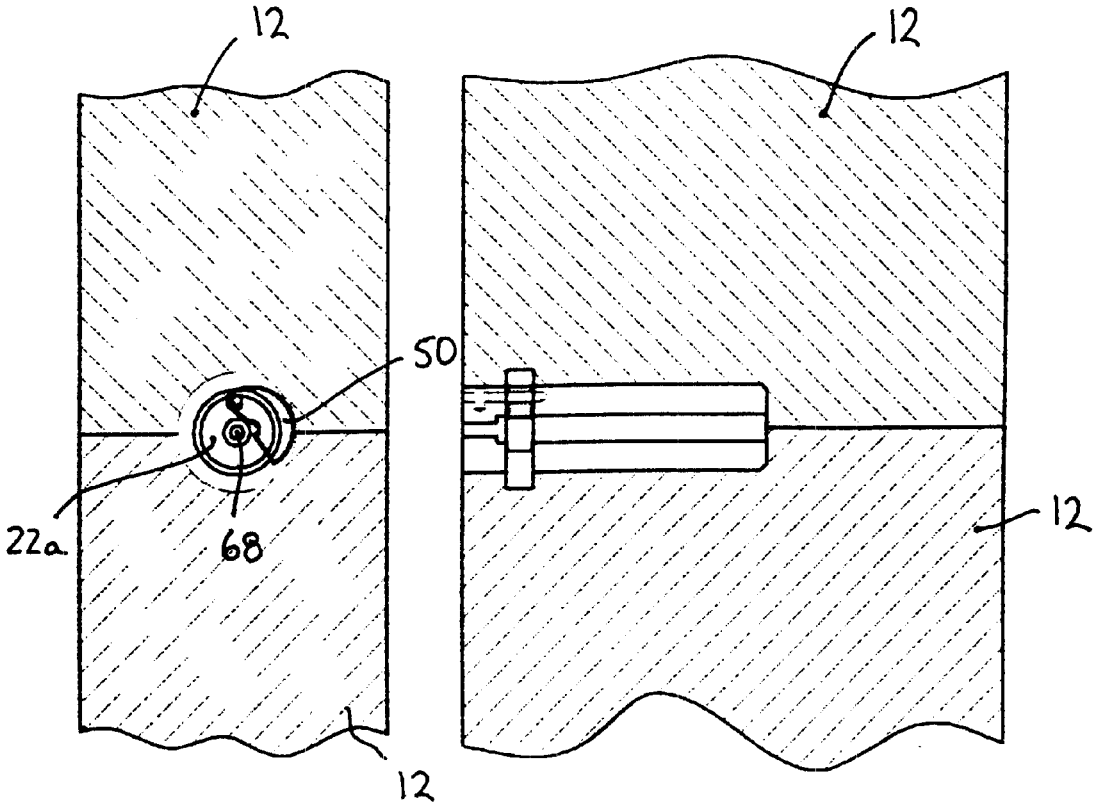
FIG. 6*a* is another elevational view similar to that of FIG. 5*a* showing a torque pin accommodated within the torque pin cavity.
FIG. 6*b* is an enlarged side elavation view of the portion of FIG. 6*b*.

FIGS. 2 to 4 better illustrate the torque pin 20. As can be seen, the torque pin 20 includes an elongate cylindrical body 22 sized to be accommodated in a torque pin cavity 18. A central longitudinal bore 24 extends through the length of the body 22. The bore 24 includes a larger diameter portion 24*a* and a shorter smaller diameter portion 24*b*. The junction between the larger and smaller diameter portions 24*a* and 24*b* respectively defines an internal shoulder 26. A cam slot 28 is provided in the sidewall of the body 22 near the top 22*a* of the body 22. The cam slot 28 intersects the larger diameter portion 24*a* of the bore 24 just below the internal shoulder 26.

The bottom of the bore 24 accommodates a blind cap 30 thereby to seal the bottom of the bore. A retaining pin 32 is received by aligned radial passages 34 provided in the body 22 and in the blind cap 30 to retain the blind cap 30 in the bore 24.

A second longitudinal bore 40 that is radially offset from bore 24 is also provided in the body 22. The bore 40 extends into the body 22 from the top 22*a* to a location slightly below the cam slot 28. A hinge pin 42 is received by the bore 40 and passes through the cam slot 28. A radially extending passage 44 extends into the body 22 near the top 22*a* and intersects the bore 40. A retaining pin 46 is accommodated by the radial passage 44 to retain the hinge pin 42 within the bore 40.

A locking element in the form of a generally semi-cylindrical cam 50 is accommodated by the cam slot 28. The cam 50 has a central semi-cylindrical recess 52 formed therein. A radially offset bore 54 is also provided in the cam 50. The hinge pin 42 passes through the bore 54 to couple pivotably the cam 50 and the body 22. In this manner, the cam 50 is moveable relative to the body 22 between a retracted unlocking condition as shown in FIG. 2, where the outer surface of the cam 50 is flush with the outer surface 22*b* of the body 22, and an extended locking condition as shown in FIG. 3, where the cam 50 extends outwardly beyond the outer surface 22*b* of the body 22.

A retaining mechanism 60 is disposed in the bore 24 to maintain the cam 50 in one of the unlocking or locking conditions. As can be seen, the retaining mechanism 60 includes a retaining element 62 and a biasing element 64 in the form of a coil spring. The retaining element 62 is stepped to define a cylindrical larger diameter portion 66 and a cylindrical smaller diameter portion 68. The junction between the larger and smaller diameter portions 66 and 68 respectively defines an annular abutment surface 70. The coil spring 64 has one end that bears against the blind cap 30 and an opposite end that bears against the larger diameter portion 66 of the retaining element 62.

When the torque pin 20 is in the unlocking condition with the cam 50 fully accommodated by the cam slot 28, the coil spring 64 urges the retaining element 62 against the cam 50.

In this condition, the annular abutment surface 70 bears against the cam 50 and urges it upwardly within the cam slot 28. This inhibits the cam 50 from rotating about the hinge pin 42 and thereby retains the cam 50 in the cam slot 28. The smaller diameter portion 68 of the retaining element 62 passes through the cam slot 28 and partially into the smaller diameter portion 24*b* of the bore 24. The central recess 52 provided in the cam 50 accommodates the smaller diameter portion 68 of the retaining element 62.

When the torque pin 20 is in the locking condition with cam 50 extending outwardly beyond the outer surface 22*b* of the body 22, the coil spring 64 urges the retaining element 62 into the cam slot 28. In this condition, the annular abutment surface 70 bears against the internal shoulder 26 with the smaller diameter portion 68 of the retaining element 62 being fully accommodated by the smaller diameter portion 24*b* of the bore 24. The larger diameter portion 66 of the retaining element 62, which is positioned in the cam slot 28 inhibits the cam 50 from rotating about the hinge pin 42 back into the cam slot 28 and therefore, maintains the torque pin 20 in the locking condition. The lengths of the smaller diameter portion 68 of the retaining element 62 and the smaller diameter portion 24*b* of the bore 24 are about the same. Therefore, when the torque pin 20 is in the extended locking condition, the distal end of the smaller diameter portion 68 of the retaining element 62 is generally flush with the top 22*a* of the body 22. This allows a quick visual check to be made to determine if the torque pin 20 is in the locking or unlocking condition.

The installation and operation of the torque pin 20 will now be described. With the torque pin 20 in the unlocking condition, the torque pin 20 is inserted into a torque pin cavity 18. Once the torque pin is positioned in the torque pin cavity 18, a key is inserted into the bore 24 so that it bears against the top of the smaller diameter portion 68 of the retaining element 62. The key is pushed into the bore 24 to push the retaining element 62 into the bore 24 against the bias of the coil spring 64 so that the annular abutment surface 70 moves away from the cam 50. In this manner, the cam 50 is allowed to pivot out of the body 22 about the hinge pin 42 and be accommodated by the band 16*a*. At this point, the key is removed from the bore 24 allowing the coil spring 64 to urge the retaining element 62 into the cam slot 28 to bring the annular abutment surface 70 into contact with the internal shoulder 26. With the torque pin 20 in the locking condition, the cam 50 is inhibited from rotating back into the body 22. Since the cam 50 is accommodated by the band 16*a*, the torque pin 20 cannot be dislodged from the torque pin cavity 18.

If it is desired to remove the torque pin 20 from the torque pin cavity 18, the key simply needs to be inserted into the bore 24 until it bears against the retaining element 62. The key can then be used to push the retaining element 62 down into the bore 24 against the bias of the coil spring 64 until the larger diameter portion 66 of the retaining element 62 is positioned below the cam slot 28. With the larger diameter portion 66 of the retaining element 62 in this position, the cam 50 is permitted to rotate back into the cam slot 28. Once in the cam slot 28, the key can be removed from the bore 24 allowing the coil spring 64 to urge the retaining element 62 against the cam 50 thereby returning the torque pin 20 to the unlocking condition.

As will be appreciated, when the torque pin 20 is in the locking condition, because the retaining element 62 is urged to bring the annular abutment surface 70 into abutment with the internal shoulder 26, the retaining element 62 is fully captured within the bore 24 and cannot escape. As a result, the torque pin 20 cannot inadvertently move from the locking to the unlocking condition. Also, a simple visual check can be made to determine if the torque pin 20 is in the locking position by ensuring that the smaller diameter portion 68 of the retaining element 62 is generally flush with the top 22*a* of the body 22.

The present torque pin can be installed and removed quickly by a single technician thereby significantly reducing the manpower required during installation and maintenance of turbines as compared to prior art torque pin designs. Although a preferred embodiment of the present invention has been described, those of skill in the art will appreciate that variations and modifications may be made without departing from the spirit and scope thereof as defined by the appended claims.

What is claimed is:

1. A torque pin to maintain rotating disks of a turbine in alignment comprising:

an elongate body having a slot provided in a sidewall thereof;

a locking element coupled to said body and being moveable relative to said body from a retracted condition where said locking element is accommodated in said slot to an extended condition where said locking element extends outwardly beyond said sidewall; and a retaining mechanism disposed in said body, said retaining mechanism being biased towards said slot to maintain said locking element in said extended condition.

2. A torque pin according to claim 1 wherein said retaining mechanism maintains said locking element in said retracted condition and in said extended condition.

3. A torque pin according to claim 2 wherein said retaining mechanism extends into said slot when said locking element is in said extended condition thereby to inhibit said locking element from moving to said retracted condition.

4. A torque pin according to claim 3 wherein said retaining mechanism abuts said locking element when said locking element is in said retracted condition thereby to maintain said locking element in said retracted condition.

5. A torque pin according to claim 4 wherein said retaining mechanism includes a spring and a retaining element, said spring urging said retaining element into contact with said locking element when said locking element is in said retracted condition and urging said retaining element into said slot when said locking element is in said extended condition.

6. A torque pin according to claim 5 wherein said retaining element is moveable within said body against the bias of said spring to enable said locking element to move from said extended position back to said retracted condition.

7. A torque pin according to claim 6 wherein said body has a centrally disposed bore therein, said bore including a larger diameter portion and a smaller diameter portion to define an internal shoulder, said larger diameter portion intersecting said slot, and wherein said retaining element includes a smaller diameter portion and a larger diameter portion to define an annular abutment surface, said spring being disposed in the larger diameter portion of said bore and bearing against the larger diameter portion of said retaining element, said annular abutment surface contacting said locking element when said locking element is in said retracted condition and contacting said internal shoulder when said locking element is in said extended condition thereby to position said larger diameter portion in said slot.

8. A torque pin according to claim 7 wherein the smaller diameter portion of said bore extends to the end of said body and wherein the smaller diameter portion of said bore and the smaller diameter portion of said retaining element are generally the same length.

9. A torque pin according to claim 3 wherein said locking element is a cam pivotably coupled to said body.

10. A torque pin comprising:

a generally cylindrical body defining an external sidewall and having a longitudinally extending bore formed therein, said body also having a radially extending slot provided in said sidewall that intersects said bore;

a cam pivotally coupled to said body and being accommodated by said slot, said cam being moveable between an unlocking condition where said cam is fully accommodated by said slot and a locking condition where said cam is partially accommodated by said slot and extends outwardly beyond said sidewall; and a retaining mechanism disposed in said bore, said retaining mechanism acting on said cam when said cam is in said unlocking condition and moving into said slot when said cam is in said locking condition thereby to inhibit said cam from returning to said unlocking condition.

11. A torque pin according to claim 10 wherein said retaining mechanism provides a visual indication of the condition of said cam.

12. A torque pin according to claim 11 wherein said retaining mechanism includes a retaining element having a larger diameter portion and a smaller diameter portion, the junction between said larger and smaller diameter portions defining an annular abutment surface; and a spring element acting on said retaining element and biasing said retaining element towards said slot, said smaller diameter portion being visible within said bore to provide said visual indication.

13. A torque pin according to claim 12 wherein said smaller diameter portion is generally flush with an end of said body when said cam is in said locking condition.

14. A torque pin according to claim 13 wherein said spring element is a coil spring and wherein said annular abutment surface contacts said cam when said cam is in said unlocking condition and contacts an internal shoulder within said body when said cam is in said locking position.

15. A turbine comprising:

a rotatable shaft;

a plurality of disks on said shaft, adjacent disks having facing recesses formed therein to define torque pin cavities; and torque pins accommodated in said torque pin cavities, each of said torque pins including:

an elongate body having a slot provided in a sidewall thereof;

a locking element coupled to said body and being moveable relative to said body between a retracted condition where said locking element is accommodated in said slot and an extended condition where said locking element extends outwardly beyond said sidewall; and a retaining mechanism disposed in said body, said retaining mechanism being biased towards said slot to maintain said locking element in said extended condition.

16. A turbine according to claim 15 when said retaining mechanism acts on said locking element when said locking element is accommodated by said slot and moves into said slot when said locking element is in said extended position to inhibit said cam from moving back into said slot.

17. A turbine according to claim 16 wherein said retaining mechanism provides a visual indication of the condition of said cam.

18. A turbine according to claim 17 wherein said retaining mechanism includes a retaining element having a larger diameter portion and a smaller diameter portion, the junction between said larger and smaller diameter portions defining an annular abutment surface; and a spring element acting on said retaining element and biasing said retaining element towards said slot, said smaller diameter portion being visible within said bore to provide said visual indication.

19. A turbine according to claim 18 wherein said smaller diameter portion is generally flush with an end of said body when said cam is in said locking condition.

20. A turbine according to claim 19 wherein said spring element is a coil spring and wherein said annular abutment surface contacts said cam when said cam is in said unlocking condition and contacts an internal shoulder within said body when said cam is in said locking position.

* * * * *